US005550435A

United States Patent [19]

Kuriyama et al.

[11] Patent Number: 5,550,435

[45] Date of Patent: Aug. 27, 1996

[54] FIELD EMISSION CATHODE APPARATUS

[75] Inventors: Toshihide Kuriyama; Hideo Makishima, both of Tokyo, Japan

[73] Assignee: NEC Corporation, Tokyo, Japan

[21] Appl. No.: 330,582

[22] Filed: Oct. 28, 1994

[30] Foreign Application Priority Data

Oct. 28, 1993 [JP] Japan ..... 5-270632

[51] Int. Cl.[6] ..... G09G 3/10

[52] U.S. Cl. ..... 315/169.1; 315/169.3; 315/167; 313/309; 313/336

[58] Field of Search ..... 315/169.1, 169.3, 315/167; 313/309, 336

[56] References Cited

U.S. PATENT DOCUMENTS

| | | | |
|---|---|---|---|
| 4,940,916 | 7/1990 | Borel et al. . | |
| 5,162,704 | 11/1992 | Kobori et al. . | |
| 5,212,426 | 6/1993 | Kane | 315/169.1 |

FOREIGN PATENT DOCUMENTS

| | | |
|---|---|---|
| 0316214 | 5/1989 | European Pat. Off. . |
| 0496572A1 | 7/1992 | European Pat. Off. . |
| 0496576A2 | 7/1992 | European Pat. Off. . |
| 4-249026 | 9/1992 | Japan . |
| WO92/04732 | 3/1992 | WIPO . |
| WO92/05571 | 4/1992 | WIPO . |

OTHER PUBLICATIONS

"Field Effect Controlled Vacuum Field–Emission Cathodes", by Ting et al., Tech. DIG. of IVMC 91, Nagahama 1991, pp. 200–201.

*Primary Examiner*—Frank Gonzalez
*Assistant Examiner*—Reginald A. Ratliff
*Attorney, Agent, or Firm*—Popham, Haik, Schnobrich & Kaufman, Ltd.

[57] ABSTRACT

It is the object of the invention to provide a field emission cathode apparatus comprising plural electron-emitters which eliminates nonuniformity of electric emission density over an emissive area, controls emission currents by active devices, and improves reliability of the apparatus. P-type silicon 5 and n-type silicon 4 are formed on $n^+$-type silicon 6. On n-type silicon 4, an electron-emitter 1 made of Mo is formed, and electron-emitter 1 is surrounded by a grid electrode 2 and an insulator layer 3. N-type silicon 4 serves as a channel region of a junction gate field effect transistor, and a current flowing through it is controlled by a voltage applied to p-type silicon 5. Accordingly, an electron current emitted from electron-emitter 1 is also controlled by this transistor, and by setting up an operation region of this transistor in a saturation current region, nonuniformity of electron emissions from electron-emitters can be improved. Even when a portion of cathodes is damaged, the damage is not magnified to the whole apparatus, and the life of the field emission cathode can be prolonged.

16 Claims, 2 Drawing Sheets

FIELD EMISSION CATHODE APPARATUS

FIELD OF THE INVENTION

The invention relates to a field emission cathode apparatus, especially to a field emission cathode apparatus in which every cone shaped elementary electron hereafter emitter (electron-emitter,) is controlled by an active device.

BACKGROUND OF THE INVENTION

Field emission apparatus is widely used in various equipment such as cathode ray tubes of displays, vacuum tubes for microwave technologies or sensors as electron sources.

A conventional field emission cathode apparatus comprises two important parts: a cathode electrode, and a grid electrode.

A cathode electrode comprises a metallic plane and cone shaped electron-emitters with upward apecies, which are made of a metal with a high melting point. Cone shaped electron-emitters are positioned on lattice points which are assumed on a metallic plane.

A grid electrode is a planar plate of a metal with a high melting point that is provided with circular holes, centers of which are positioned on lattice points assumed on a planar plate. Geometrical parameters of two sets of lattice points are the same.

Cathode and grid electrodes are combined so that, planar portions of these electrodes are parallel to each other, and an apex of each cone shaped electron-emitter is surrounded by an inner periphery of a circular hole of a grid electrode.

In this construction, when a voltage is applied between a cathode and a grid electrode, a high electric field is generated around an apex of an electron-emitter, and electrons are emitted from the apex, which is known as high field emission.

On a field emission cathode apparatus, however, several disadvantages have been pointed out.

(1) When there are random imperfections in shapes or dimensions of electron-emitters or a grid electrode, nonuniformity of electron emission arises over a whole emissive area of the apparatus.

(2) When a breakdown arises between a electron-emitter and a grid electrode, there is no means to suppress a short circuit current, and a scale of damage is magnified.

(3) There is no means to control magnitude of electron emission, and therefore this cathode apparatus is unsuitable for display means.

SUMMARY OF THE INVENTION

Accordingly, it is an object of the invention to provide a field emission cathode apparatus which has uniform density of electron emission over a whole emissive area of the apparatus, and means to modulate an emission current of each electron-emitter at will, and means to limit a short circuit current flowing into each electron-emitter in a case of break-down between an electron-emitter and a cathode electrode.

According to the object of the invention, a field emission cathode apparatus comprises:

metallic electron-emitters with pointed ends and a grid electrode which includes a metallic planar electrode provided with circular holes arranged on its surface, wherein each of the holes concentrically surrounds each of the electron-emitters, and a DC voltage for generating field emissions is applied therebetween, and active devices, each of which is connected to at least one electron-emitter in series, control an electric current supplied to at least one electron-emitter, and has a saturation characteristic of an electric current, and a withstand voltage higher than a voltage between the grid electrode and electron-emitters.

BRIEF DESCRIPTION OF THE DRAWINGS

The invention will be explained in more detail in conjunction with the drawings, wherein.

DESCRIPTION OF THE PREFERRED EMBODIMENTS

Before explaining a field emission cathode apparatus in the preferred embodiments according to the invention, the aforementioned conventional field emission cathode apparatus will be explained referring to FIG. 1.

When a pointed end of a cone shaped electrode having a small size is exposed to high electric field, electron emission arises at the pointed end. The Spindt-Type electrode for electric field emission shown in FIG. 1 is known as a typical example of such electrodes.

Figure 1:
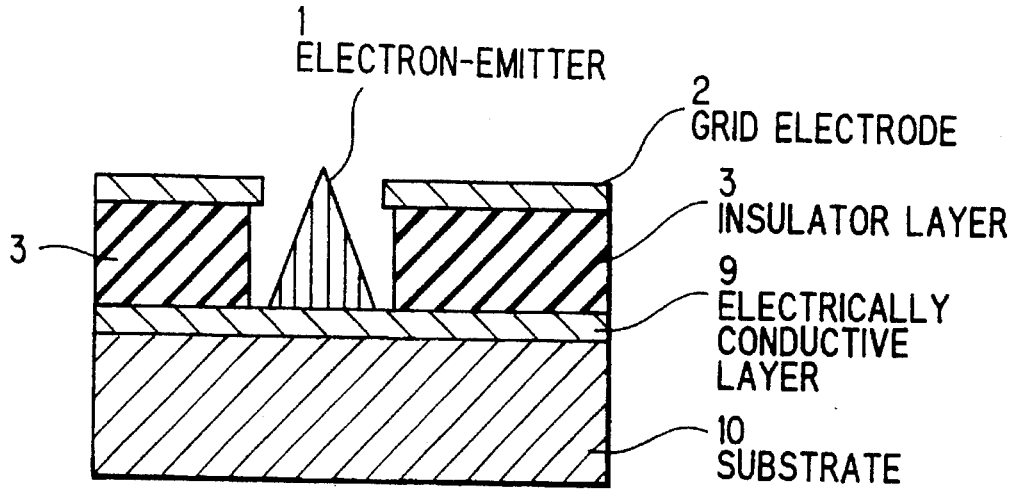
FIG. 1 PRIOR ART
FIG. 1 is a cross-sectional view which represents a conventional field emission cathode apparatus.

In FIG. 1, 10 is an insulator substrate such as glass. 9 is an electrically conductive layer, which is made of a metal such as A1, and formed on insulator substrate 10. On electrically conductive layer 9, electron emitters 1, which are made of a metal with a high melting point such as W, or Mo, and shaped into cones with pointed apices, and are arranged on lattice points assumed on a surface of electrically conductive layer 9. Each of these emitters 1 is surrounded by an insulator layer 3 made of a suitable material, such as $SiO_2$ and a grid electrode 2 made of a metal such as Mo, W, or Cr.

In such a field emission cathode apparatus, when a voltage is applied between grid electrode 2 and electrically conductive layer 9, such that field intensities near apices of electron-emitters 1 are about $10^7$ V/cm or more, electrons are emitted from electron-emitters 1.

By combining large numbers of electron-emitters, an electron beam corresponding to an electric current with desired magnitude can be obtained. However, if there are slight imperfections in shapes of electron-emitters 1 and grid electrode 2, nonuniformity of electron emission density arises, and the life of the whole apparatus is reduced on account of breakdowns of a portion of the electron-emitters 1.

As a method to prevent such undesirable phenomena, the Minister of The Atomic Power Development of France (Commissariat a l'Energie Atomique, France) proposed to insert a resistive film, made of Si, between the electrically conductive layer and the electron-emitters, wherein a thickness of a resistive film is several Å to several μm, and a specific resistant of a resistive material is several hundreds to several million Ω·cm. In that construction, nonuniformity of electron emission density was decreased to some extend. Moreover, when insulation between electron-emitters and a grid electrode are deteriorates, currents flowing into electron-emitters are limited by a resistive layer which exists between electron-emitters and the resistive layer, and of damage of electron-emitters and the grid electrode on account of short circuit currents between these electrodes is reduced.

As another counter measure, Futaba Electronic Industrial Co. has proposed to insert constant current devices between each electron emitter and a electrically conductive layer, (Japanese Patent Kokai No. 4-249026).

In a conventional method in which a resistive layer is inserted between electron-emitters and the electrically conductive layer, voltage drops at the resistive layer are considerably large, and therefore it becomes necessary to increase the applied voltage between electron-emitters and the conductive layer, and uniformity of emitted electron density is not satisfactory. Moreover, in another conventional method using constant current devices, uniformity of electron emission density is largely improved, however, this method cannot be applied to electron guns of a cathode ray tube (CRT, hereinafter), because it is necessary to modulate brightness of a picture by varying the quantity of electrons of electron beams.

In this construction, an emission current of each electron-emitter is limited by the active device with an saturation current, which is connected in series to a electron-emitter, and therefore nonuniformity of electron emission density over the emissive surface due to random imperfections of shapes and dimensions of electron-emitters and a grid electrode can be prevented. Moreover, even when a portion of electron-emitters are broken-down, short circuit currents are limited by active devices with saturation currents, the scale of damage is not magnified, and the expected life span of the apparatus is prolonged.

Hereafter, preferred embodiments of the invention will be explained in detail referring to FIGS. 2 to 4.

FIG. 1 shows a cross-sectional view of a field emission cathode apparatus according to the first preferred embodiment of the invention. In FIG. 1, 1 is an electron-emitter made of Mo and having a pointed end, 2 is a grid electrode made of W, 3 is an insulator layer made of $SiO_2$, 4 is a cylindrical n-type silicon provided under an electron-emitter 1, 5 is a p-type silicon surrounding a n-type silicon 4, and 6 is $n^+$-type silicon. The electron-emitter 1 is shaped into a cone with a sharp pointed apex having a height of 0.5 to 1.0 μm. N-type silicon 4, p-type silicon 5 and $n^+$-type silicon 6 constitute an n-channel junction gate field effect transistor, wherein electron-emitter 1, n-type silicon 4, p-type silicon 5 and $n^+$-type silicon 6 correspond to a drain, an n-channel, a gate and a source respectively. By varying the voltage applied to p-type silicon 5, the electric current flowing in the n-channel, (n-type silicon 4), can be controlled. Moreover, the withstand voltage between source and drain electrodes of this junction gate field effect transistor should be higher than the voltage applied between electron-emitter 1 and grid electrode 2 to generate field emission from electron-emitter 1. If we denote the impurity density and the depth of the n-type silicon, which serves as a channel of the junction gate field effect transistor, by n and w respectively, it is sufficient that the following relations are satisfied.

$$n \approx p,$$

$$w > 2V_0/\epsilon,$$

wherein, 2 is a safety factor, p is the impurity density of the p-type silicon 5, which surround the n-type silicon 4, ∈ is the break-down field intensity of silicon, and $V_0$ is the voltage to be applied between the electron-emitter 1 and the $n^+$-type silicon 6 in a case of breakdown. It should be noted that $V_0$ is nearly equal to the voltage applied between electron-emitter 1 and grid electrode 2 to generate field emission during normal operation.

Moreover, when electron-emitter 1 and grid electrode 2 are short circuited by breakdown, the voltage of n-type silicon 4 near electron-emitter 1 is increased, and a high inverse bias voltage is impressed against p-type silicon 5. Since impurity density n is low, almost all carriers of n-type silicon 4 are depleted near electron-emitter 1, even when inverse bias voltage is not so high. Therefore, during breakdown, a pinch-off resistance arises in n-type silicon 4 near electron-emitter 1, and thereby short circuit current can be limited.

As mentioned above, if the above relations are satisfied, even when a portion of the electron-emitters and the gate electrodes are short circuited by breakdowns, short-circuit currents are respectively limited by n-type silicon 4 connected to broken electron-emitters, and therefore damage of the whole apparatus can be prevented. The above mentioned "current limiting characteristic" of the active device may be expressed as "saturation characteristic of electric current".

Figure 3:
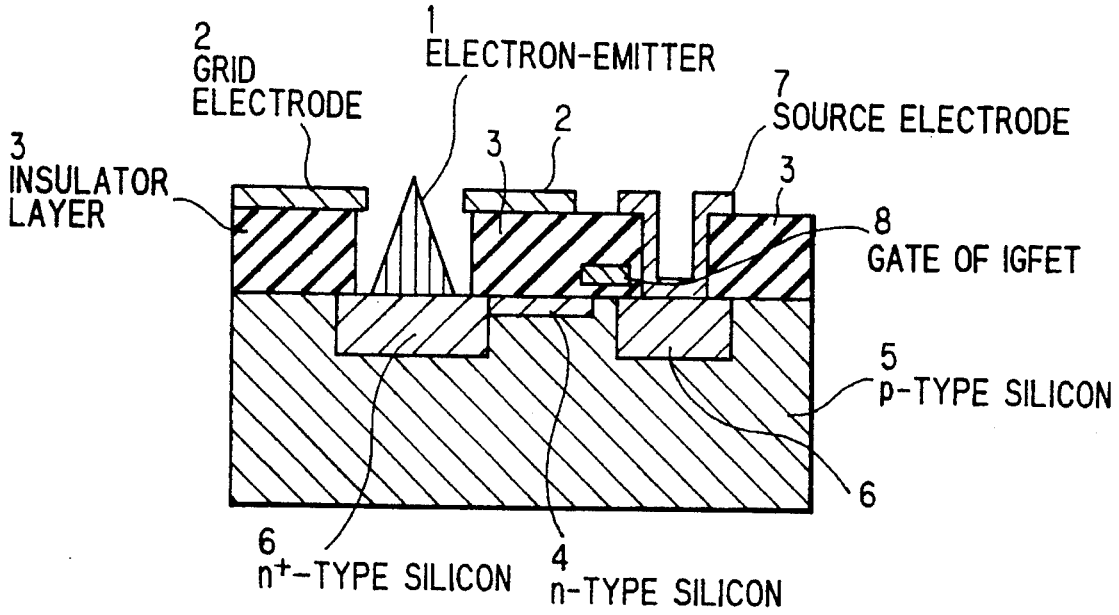
FIG. 3 is a cross-sectional view of a field emission cathode apparatus using insulated 9ate field effect transistors as a second preferred embodiment of the invention.

FIG. 3 shows a cross-sectional view of a field emission cathode apparatus according to the second preferred embodiment of the invention. In this drawing, 1 is an electron emitter having a pointed end and being made of Mo, 2 is a grid electrode made of W, 3 is an insulator layer made of $SiO_2$ 4 is n-type silicon, 5 is p-type silicon, and 6 is $n^+$-type silicon, 7 is a source electrode made of a metal, and 8 is a gate electrode of an insulated gate field effect transistor (hereinafter IGFET). Electron-emitter 1 is shaped into a cone having a height of 0.5 to 1.0 μm and surrounded by insulator layer 3 and grid electrode g at a radial distance of 0.5 to 1.0 μm. N-type silicon 4, p-type silicon 5, $n^+$-type silicon 6, source electrode 7 and gate electrode 8 constitute an IGFET. Electron-emitter 1 and $n^+$-type silicon 6 serve as a drain electrode in one. By varying the voltage of gate electrode 8, the electric current starting from electron-emitter 1 and flowing along $n^+$-type silicon 6, n-type silicon 4, a surface of p-type silicon 5 under gate electrode 8, which serve as a channel, and arriving at source electrode 7 can be controlled.

It is necessary that the withstand voltage between source and drain electrodes of the IGFET is higher than the voltage applied between electron-emitter 1 and grid electrode 2 for generating field emission. For this purpose, by using a region of n-type silicon 4 as a pinch-off resistance, a n-type silicon 4 can withstand the voltage to be applied to $n^+$-type silicon 6, which serves as a drain electrode of the IGFET, So that the apparatus has a high withstand voltage. For example, when an impurity density of p-type silicon 5 is $1\times10^{15}$ $cm^{-3}$, the impurity density per unit area of n-type silicon is $2\times10^{12}$ $cm^{-2}$ and its lateral length is 10 μm, the withstand voltage is larger than 100 V.

Figure 2:
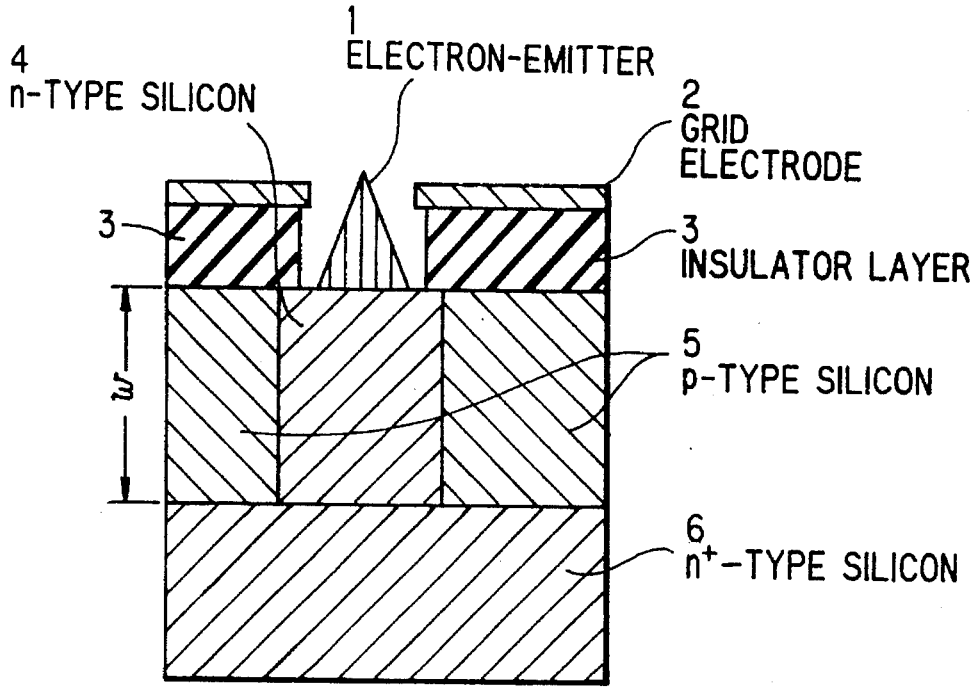
FIG. 2 is a cross-sectional view of a field emission cathode apparatus using junction gate field effect transistors as a first preferred embodiment of the invention.

When electron-emitter 1 and the grid electrode are short circuited, the voltage of n-type silicon 4 near $n^+$-type silicon 6 is increased and a similar phenomenon to that described in the case of FIG. 2 arises, and a short-circuit current can be limited, because n-type silicon 4 is embedded in a p-type silicon 5. Accordingly, in a case of break-down, a substantial portion of a breakdown voltage is shared by a pinch-off resistance of n-type silicon 4, and an electric field along a surface of p-type silicon 5 under gate electrode 8 of the IGFET is extremely small. Therefore, gate electrode 8 of the IGFET is not exposed to a high voltage, and the insulation layer between a gate electrode 8 of the IGFET and a surface of p-type silicon 5 can be narrowed. Hence, a mutual conductance of an IGEFT can be increased, and a current therethrough can be controlled by a small control voltage. If n-type silicon 4 is not used in the construction shown in FIG. 3, gate-electrode 8 of the IGFET must withstand against a considerable portion of breakdown voltage, and must be protected by a thick layer of insulator. Then, the distance between gate electrode 8 and a surface of the p-type silicon is increased.

Therefore, in cases of normal operation, a mutual conductance of the IGFET is largely decreased, and a large control voltage is required. Moreover, it is difficult to limit a short circuit current, because effective pinch-off resistances do not arise in $n^+$-type silicon 6.

Accordingly, when a portion of electron-emitters and the grid electrode are damaged by breakdown and short circuited, the short circuit currents are limited by n-type silicon 4, and local damage is not magnified to the whole apparatus. The above mentioned "current limiting characteristic" of an active device may be expressed as "saturation characteristic of electric current".

Figure 4:
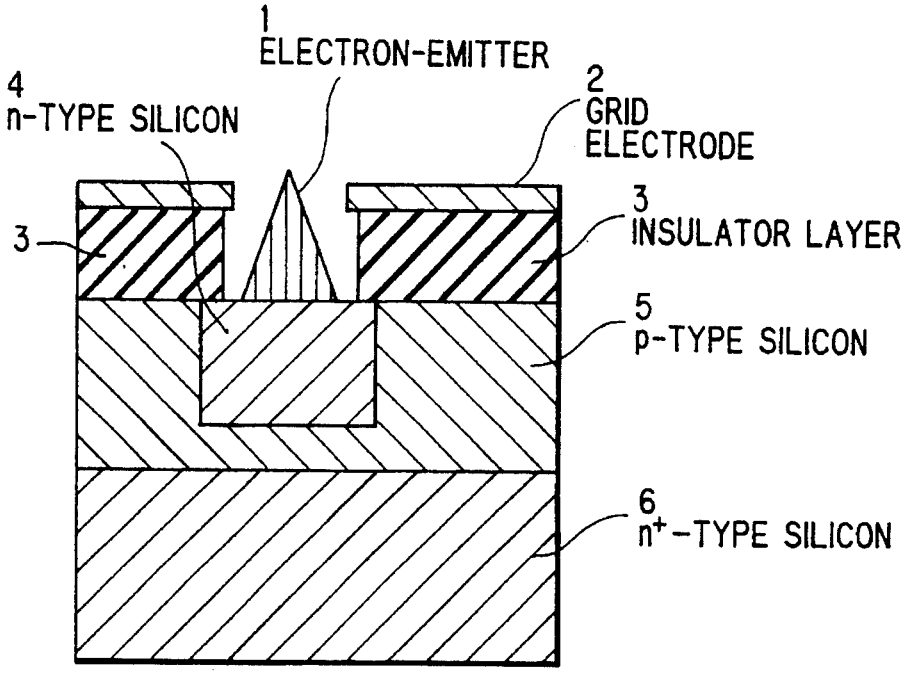
FIG. 4 is a cross-sectional view of a field emission cathode apparatus using bipolar transistors as a third preferred embodiment of the invention.

FIG. 4 shows a cross-sectional view of a field emission cathode apparatus according to the the third preferred embodiment of the invention. In this drawing, 1 is an electron emitter made of Mo and having a sharp pointed end and, 2 is a grid electrode made of W, 3 is an insulator layer made of $SiO_2$, 4 is n-type silicon, 5 is p-type silicon, and 6 is $n^+$-type silicon. Electron-emitter 1 is shaped into a cone having a height of 0.5 to 1.0 μm and being surrounded by insulator layer 3 and grid electrode 2 at a radial distance of 0.5 to 1.0 μm. N-type silicon 4 is provided under electron-emitter 1, has a cylindrical form and is buried in p-type silicon 5. N-type silicon 4, p-type silicon 5 and $n^+$-type silicon 6 constitute a bipolar transistor, and by varying the voltage of p-type silicon 5, which corresponds to a base electrode of this bipolar transistor, electric current that starts from electron-emitter 1 and flows to a $n^+$-type silicon 6 corresponding to an emitter electrode, and passes through n-type silicon 4 and p-type silicon 5 corresponding to collector and base electrodes respectively, can be controlled. Denoting the length of the n-type silicon 4 and the voltage applied between an electron-emitter 1 and $n^+$-type silicon 6 by w and $V_0$ respectively, w can be determined by the following inequality.

$$n \approx p,$$

$$w > 2\ V_0/\epsilon$$

wherein, 2 is a safety factor, p is an impurity density of the p-type silicon 5, and $\epsilon$ is the breakdown field intensity of silicon. It should be noted that $V_0$ is nearly equal to the voltage applied between electron-emitter 1 and grid electrode 2 to generate field emission in a case of normal operation.

When electron emitter 1 and a grid electrode 2 are short-circuited by breakdown, the voltage of n-type silicon 4 near electron-emitter 1 is increased, and a similar phenomenon to those described in the cases of FIG. 2 and FIG. 3 arises. A short circuit current can be limited, because n-type silicon 4 is surrounded by p-type silicon 5. Accordingly, a short circuit is limited by a pinch-off resistance, which is produced in n-type silicon 4 near electron emitter 1.

As mentioned above, if the above conditions are satisfied, even when portions of electron-emitter 1 and a grid electrode 2 are damaged by breakdown and short circuited, short circuit currents are limited by n-type silicon 4, and damage is not magnified to the whole apparatus. The above mentioned "current limiting characteristic" of an active device may be expressed as "saturation characteristic of electric current".

In the embodiments described above, one active device with saturation characteristic of electric current is connected to one electron-emitter, however, it is possible to connect one active device to several of electron-emitters. In such a construction, when one electron emitter is damaged, electron-emitters belonging the same group cannot operate, however, all other electron-emitters can operate normally, and therefore, reliability of the apparatus can be maintained, and its life is prolonged.

As described above, in a field emission cathode apparatus according to the invention, since an emission current from each electron-emitter is determined by an active device, which is connected to an electron-emitter in series and has a saturation characteristic of electric current, nonuniformity of emission current density over a whole emissive area, which is caused by random imperfections of shapes and dimensions of electron-emitters and a grid electrode, can be eliminated. Moreover, even when portions of electron-emitters and the grid electrode are broken-down, short-circuit current flowing thereinto is limited by active devices with saturation characteristics of electric currents, and damage is not magnified to the whole apparatus, and its life can be prolonged. In addition, since the quantity of emitted electrons is controlled by active devices, there is an advantage that a control voltage can be decreased, and accordingly a field emission cathode apparatus, which is suitable for CRTs, and has uniform electron emission density over a whole emissive area and a long life, can be provided.

Although the invention has been described with respect to specific embodiments for complete and clear disclosure, the appended claims are not to be thus limited but are to be construed as embodying all modification and alternative constructions that may occur to one skilled in the art which fairly fall within the basic teaching set forth herein.

What is claimed is:

1. A field emission cathode apparatus, comprising:

an electron-emitter having a micropoint at a tip portion thereof;

an active device connected in series to said electron-emitter; and means for applying a predetermined voltage across said electron-emitter and said active device to emit electrons from said micropoint of said electron-emitter;

wherein a current flowing through said electron-emitter is modulated by said active device; and said active device has a breakdown voltage that is greater than said predetermined voltage.

2. A field emission cathode apparatus according to claim 1, wherein said active device is a junction gate field effect transistor.

3. A field emission cathode apparatus according to claim 1, wherein said active device is an insulated gate field effect transistor.

4. A field emission cathode apparatus according to claim 1, wherein said active device is a bipolar transistor.

5. A field emission cathode apparatus, according to claim 4, wherein:

said bipolar transistor includes an emitter-collector path that is connected in series to said electron-emitter.

6. The field emission cathode apparatus according to claim 2, wherein a source-drain path of said active device is connected in series to said electron emitter.

7. The field emission cathode apparatus of claim 3, wherein a source-drain path of said active device is connected in series to said electron emitter.

8. The field emission cathode apparatus of claim 1, further comprising an n-type silicon located under said electron-emitter so that said n-type silicon provides a pinch-off resistance to limit short circuit current when there is a short circuit.

9. A field emission cathode apparatus, comprising:

an electron-emitter having a micropoint at a tip portion thereof;

a grid electrode;

an active device connected in series to said electron-emitter; and means for applying a predetermined voltage across said grid electrode and an $n^+$-type source of said active device to emit electrons from said micropoint of said electron emitter;

wherein a current flowing through said electron emitter is modulated by said active device and said active device has a breakdown voltage that is greater than said predetermined voltage.

10. A field emission cathode apparatus according to claim 9, wherein said active device includes an n-type drain and is connected in series to said electron-emitter through said n-type drain.

11. A field emission cathode apparatus according to claim 9, wherein said active device includes an $n^+$-type collector and is connected in series to said electron-emitter through said $n^+$-type collector.

12. A field emission cathode apparatus according to claim 9, wherein said active device is a junction gate field effect transistor.

13. A field emission cathode apparatus according to claim 9, wherein said active device is an insulated gate field effect transistor.

14. A field emission cathode apparatus according to claim 9, wherein said active device is a bipolar transistor.

15. A field emission cathode apparatus according to claim 14, wherein said bipolar transistor includes an emitter-collector path that is connected in series to said electron-emitter.

16. A field emission cathode apparatus according to claim 9, further comprising an n-type silicon located under said electron-emitter so that said n-type silicon provides a pinch-off resistance to limit short circuit current when there is a short circuit.

* * * * *